US007249867B2

(12) United States Patent
Hagen et al.

(10) Patent No.: US 7,249,867 B2
(45) Date of Patent: Jul. 31, 2007

(54) SEALED LIGHTING FIXTURE HAVING MECHANISMS FOR VENTING AND EQUALIZING INTERIOR AIR PRESSURE

(75) Inventors: Douglas W. Hagen, Coarsegold, CA (US); Allen Alexander, Fresno, CA (US)

(73) Assignee: Coarsegold Consulting, Inc., Coarsegold, CA (US)

( * ) Notice: Subject to any disclaimer, the term of this patent is extended or adjusted under 35 U.S.C. 154(b) by 61 days.

(21) Appl. No.: 11/150,000

(22) Filed: Jun. 10, 2005

(65) Prior Publication Data

US 2006/0279951 A1 Dec. 14, 2006

(51) Int. Cl.
*F21V 29/00* (2006.01)

(52) U.S. Cl. ..... 362/267; 362/264; 362/362; 362/147

(58) Field of Classification Search ..... 362/267, 362/362, 153.1, 147, 148, 153, 364, 480, 362/294, 373, 264, 547; 137/493.8, 846; 138/46

See application file for complete search history.

(56) References Cited

U.S. PATENT DOCUMENTS 3,989,061 A * 11/1976 Pelton ..... 137/505
5,251,111 A * 10/1993 Nagengast et al. ..... 362/547
5,269,208 A 12/1993 Kolvites et al. ..... 81/176.2
6,161,948 A 12/2000 Hagen ..... 362/418
6,254,258 B1 7/2001 Case ..... 362/373
2002/0159273 A1* 10/2002 Erion ..... 362/547
2004/0246709 A1* 12/2004 Hagen ..... 362/153.1

OTHER PUBLICATIONS

Journal of Hydraulic Research, vol. 39, 2001, No. 6, On The Head-Discharge Relation of a "Duckbill" Elastomer Check Valve, Lee et al., pp. 619-627.

* cited by examiner

*Primary Examiner*—Renee Luebke
*Assistant Examiner*—Gunyoung T. Lee
(74) *Attorney, Agent, or Firm*—Koppel, Patrick, Heybl & Dawson

(57) ABSTRACT

A lighting fixture assembly includes a housing assembly that forms an interior. A valve mechanism is associated with the housing assembly and is configured to automatically vent fluid from the interior to the atmosphere when the pressure in the interior exceeds a threshold level. Otherwise, the valve mechanism seals the interior from the atmosphere. The lighting fixture also includes a pressure-equalization mechanism, separate from the valve mechanism, which is also associated with the housing assembly. The pressure-equalization mechanism is configured to, upon activation, substantially equalize the interior pressure with the atmosphere pressure and to otherwise seal the interior from the atmosphere.

20 Claims, 2 Drawing Sheets

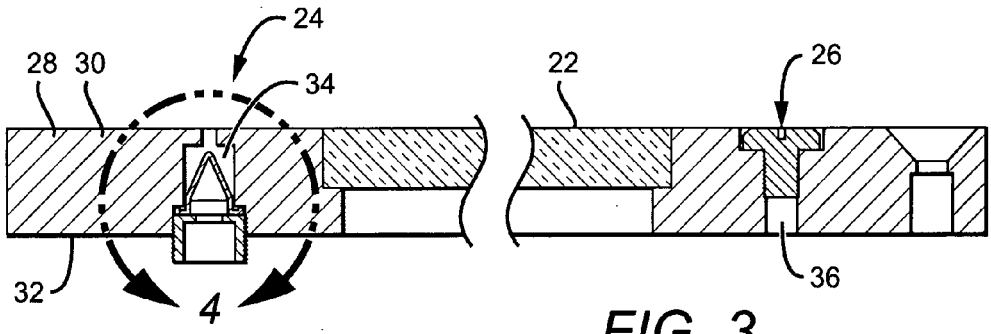
FIG. 3
FIG. 4
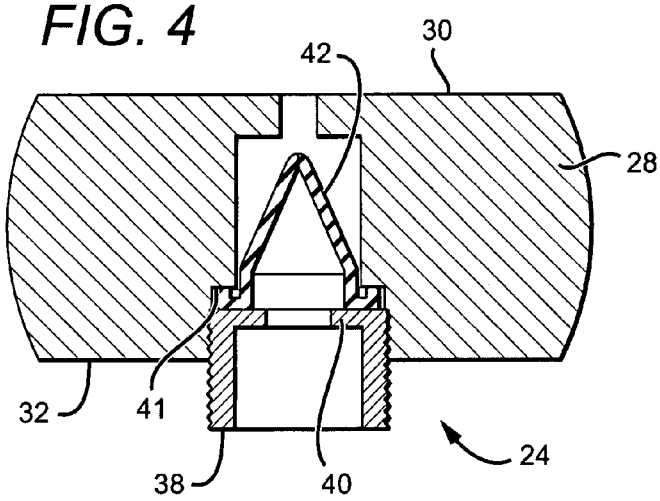
FIG. 5
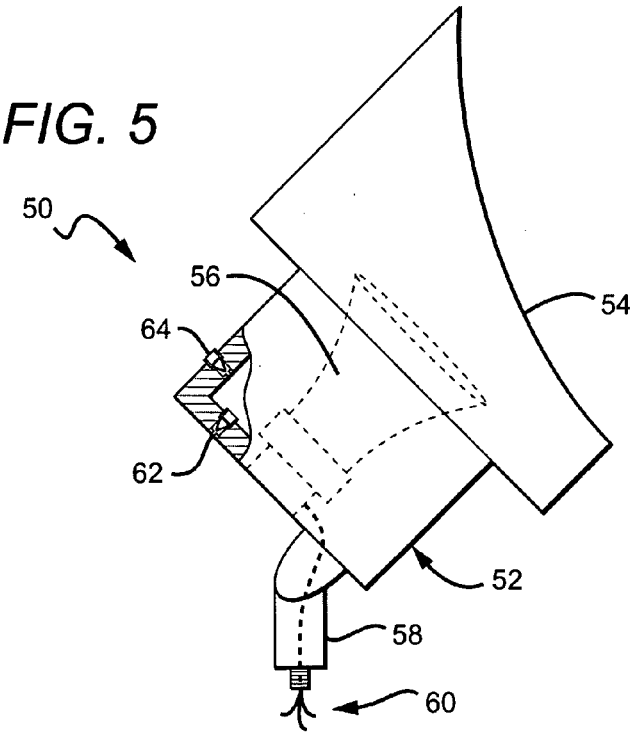

SEALED LIGHTING FIXTURE HAVING MECHANISMS FOR VENTING AND EQUALIZING INTERIOR AIR PRESSURE

BACKGROUND OF THE INVENTION

1. Field of the Invention

This invention relates generally to lighting fixtures, and more particularly, to sealed lighting fixtures comprising a valve mechanism that allows for the venting of air from within the fixture, and a pressure-equalization mechanism that allows for the equalization of the air pressure in the fixture with the atmosphere.

2. Description of Related Art

The use of lights in outdoor applications is commonplace. These applications generally require a sealed or near-sealed lighting fixture to prevent moisture from entering the light housing, lamp or electrical circuit components of the lighting system to prevent damage or injury that can result from moisture contact with an electrical system. The typical outdoor lighting fixture has a housing assembly that attaches to a junction box or other source of electricity. The housing assembly includes a housing shell and a cap or faceplate assembly that connects to the housing shell to form an interior that encloses the lamp. Gaskets are typically utilized between the various members of the lighting fixture to prevent the intrusion of moisture.

Despite the significant operational and safety advantages of using a completely sealed housing, the sealing of the housing makes assembly and disassembly of the lighting fixture very difficult. In order to assemble the lighting fixture, the faceplate assembly or cap must be placed on the housing and locked into place. If the housing is sealed such that the completed assembly will be airtight, the action of placing the cap on the housing compresses the air inside the housing and makes placement of the cap on the housing difficult. Once the cap is in place on the housing, the high internal pressures that exist make locking the cap to the housing very difficult. Brute force or some type of mechanical advantage must be used in order to seal the cap onto the housing. Once the cap is installed, the sealed lighting fixture must be able to withstand the increased internal pressure that results from the heating of the air inside the fixture when the lamp is on. The problems with utilizing a sealed housing are compounded with larger size lighting fixtures which generate more heat.

To avoid the problems described above, most lighting fixtures are manufactured so they are not completely air-tight. Fixtures that are not air-tight have a mechanism to vent the pressures that result from assembling the lighting fixture and the pressure that results from the heating up of air inside the housing during operation.

Unfortunately, while the air inside the housing is cooling after the lamp is turned off outside air is drawn inside the housing as the pressure inside the housing lowers. This drawing in of outside air brings moisture and contaminants that are also in the air (such as salt for installations near salt water) inside the housing. The resulting moisture inside the housing can cause condensation that can result in corrosion and/or problems with the electrical components. To avoid these problems, the internal components must be manufactured out of materials that can withstand corrosion and moisture must be prevented from entering into moisture-sensitive areas. Some manufacturers utilize chemical materials inside the lighting fixture to absorb the moisture that enters as a result of the above process.

As an alternative to the non-sealed lighting fixtures described above, some manufacturers of lighting fixtures create a vacuum inside the lamp housing during the manufacturing process. The vacuum inside the housing solves the problems with moisture and contaminates getting inside the housing and reduces or eliminates the problem with condensation. However, due to the vacuum, the owner of such a lighting fixture can only replace the lamp by removing the entire lamp housing and shipping it to the manufacturer for replacement. This creates significant difficulty and expense for the system owner.

U.S. Pat. No. 6,254,258, assigned to B-K Lighting, Inc., discloses a sealed lighting fixture having a complex mechanism that includes a valve feature that vents pressure from inside the fixture housing to the atmosphere during operation of the light. The valve also provides for the creation of a vacuum within the fixture when the light is turned off. The mechanism also includes a pressure equalizing feature that can be manually actuated to eliminate the vacuum and equalize the pressure inside the housing with the atmosphere so the housing can be disassembled and the lamp replaced.

SUMMARY OF THE INVENTION

Briefly, and in general terms, the invention is directed to sealed lighting fixtures that include a valve mechanism that allows for the creation of a vacuum within the fixture that prevents the formation of condensation, and a pressure-equalization mechanism that allows for the equalization of the pressure in the fixture with the atmosphere. In one aspect, the invention relates to a lighting fixture assembly that includes a housing assembly that forms an interior. A valve mechanism is associated with the housing assembly and is configured to automatically vent fluid from the interior to the atmosphere when the pressure in the interior exceeds a threshold level. Otherwise, the valve mechanism seals the interior from the atmosphere. The lighting fixture also includes a pressure-equalization mechanism that is separate from the valve mechanism and associated with the housing assembly. The pressure-equalization mechanism is configured to, upon activation, substantially equalize the interior pressure with the atmosphere pressure, and to otherwise seal the interior from the atmosphere.

In another aspect of the invention, a lighting fixture includes a housing assembly that has an interior and two openings connecting the interior to the atmosphere. A one-way valve is positioned in one of the openings. The one-way valve is configured to open when the pressure of the interior is greater than a predetermined pressure and to otherwise be closed to form a seal between the interior and the atmosphere. A pressure-equalization device, separate from the valve, is positioned in the other of the openings. The pressure-relief device has an opened state during which fluid communication is established between the interior and the atmosphere and a closed state during which a seal is formed between the interior and the atmosphere.

In another aspect of the invention, a lighting fixture includes a housing assembly having an interior and a light source positioned in the interior that is electrically connected to be turned on and off. The lighting fixture also includes at least two openings through the housing assembly that interconnect the interior with the atmosphere. A valve is positioned in one of the openings and is configured to open when the light source is turned on long enough to cause the air pressure in the interior to exceed a predetermined pressure. The valve is further configured to close when the light is turned off long enough to cause the air pressure in the interior to fall below the predetermined pressure. A sealing device normally closes the other of the openings and is configured to open in response to an external force.

In yet another aspect, the invention relates to a first subassembly that is configured to be secured to a second subassembly to form a lighting fixture housing assembly having an airtight interior relative to the atmosphere. The first subassembly includes a structure that has opposed first and second surfaces and two openings extending between the surfaces. A valve is positioned in one of the openings. The valve is configured to open when exposed to a pressure greater than a predetermined pressure and to otherwise close to form a seal in the opening. The subassembly further includes a pressure-equalization device that is separate from the valve. This device is positioned in the other of the openings and has an opened state during which fluid communication is established between the first surface and the second surface and a closed state during which a seal is formed in the opening.

These and other aspects and advantages of the invention will become apparent from the following detailed description and the accompanying drawings which illustrate by way of example the features of the invention.

BRIEF DESCRIPTION OF THE DRAWINGS

FIG. 3 is a cross section of the FIG. 2 taken along line 3-3 and showing the valve mechanism and pressure-equalization mechanism of FIG. 1;

FIG. 4 is a more detailed view of the valve mechanism of FIG. 3; and

FIG. 5 is a simplified, partial cross section of an above-ground lighting fixture having a valve mechanism and a pressure-equalization mechanism.

DETAILED DESCRIPTION OF THE PREFERRED EMBODIMENTS

Figure 1:
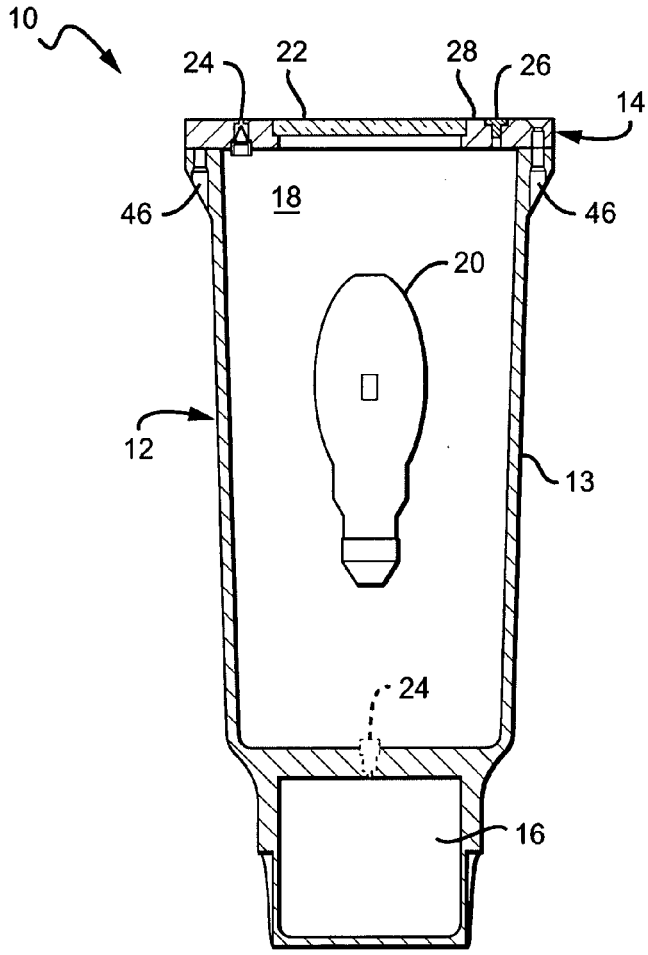
FIG. 1 is a simplified cross section of an in-grade lighting fixture including a housing assembly having a faceplate assembly with a valve mechanism and a pressure-equalization mechanism.
Figure 2:
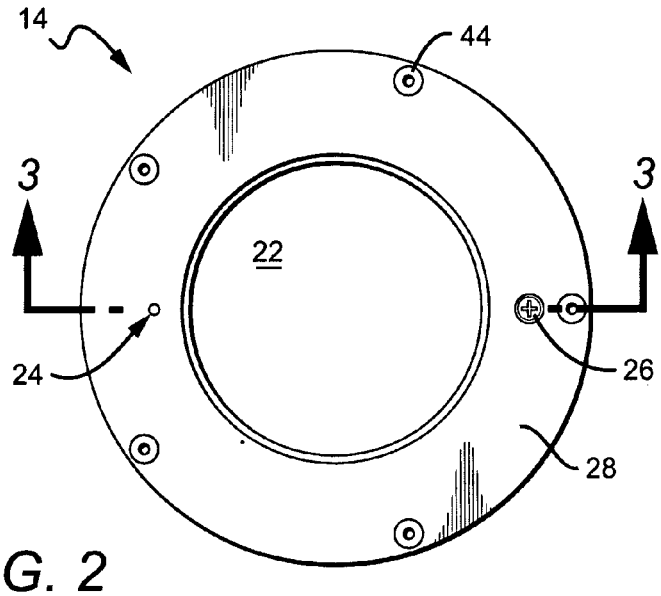
FIG. 2 is a top view of the fixture of FIG. 1.

Referring now to the drawings and particularly to FIGS. 1 and 2, there is shown a lighting fixture 10 configured in accordance with the invention. The particular type of lighting fixture 10 shown in FIG. 1 is an in-grade lighting fixture. As described later, the invention may find application in other types of lighting fixtures, including above-ground landscape lights and architectural lights. However, for purposes of initial description, the invention is described with reference to in-grade lighting fixtures.

The fixture 10 includes a housing assembly 12 and a junction box 16. The junction box 16 may be formed as part of the housing assembly 12, as shown, or it may be a separate component that is coupled to the housing assembly. The housing assembly 12 includes a housing shell 13 and a faceplate assembly 14. A housing interior 18 is defined by the housing shell 13 and faceplate assembly 14. Positioned within the housing interior 18 is a lamp 20. The faceplate assembly 14 includes a support ring 28 and a window 22 that allows light from the lamp 20 to exit the interior 18.

The fixture 10 also includes a valve mechanism 24. The valve mechanism 24 provides for fluid, e.g., gas, air, communication between the housing interior 18 and the outside atmosphere. In general the valve mechanism 24 may be located anywhere on the housing 12 assembly that is accessible to the atmosphere. In one configuration, the valve mechanism 24 is located in the faceplate assembly 14 on a portion that would be exposed to the atmosphere upon installation of the fixture 10. Alternatively, as indicated in phantom, the valve mechanism 24 may be positioned in a lower portion of housing shell 13 so that it connects the interior 18 with the inside of the junction box 16. In some embodiments, the junction box is not air tight. For example, in one embodiment air can pass out of the junction box through a conduit connector to the junction box 16. The conduit connector is used to connect a conduit to the junction box 16 for power conductors to pass into the junction box 16. Having the valve mechanism at the junction box 16 may be more cosmetically appealing in that it allows the housing interior 18 to vent into the junction box 16 beneath the ground, and thus avoids the need for a visible hole in the exposed portion of the faceplate assembly 14.

Valve mechanism 24 allows for the release of expanding air from the interior 18 and prevents the suction of air and contaminants back into the interior. More specifically, when the lamp 20 is turned on, the heat from the illumination causes the air in the housing interior 18 to increase in temperature and expand. This expansion produces a corresponding increase in pressure. When the interior pressure increases to a level greater than the threshold level associated with the valve mechanism 24, the valve mechanism opens, allowing the interior air to vent through to the exterior environment. The threshold level associated with the valve is defined by the structure of the valve. For instance, in the case of duckbill valve mechanisms having a higher threshold, the duckbill mechanism is able to withstand greater pressures before separating to allow air to pass. The threshold can range anywhere from just above zero pounds per square inch (psi) to hundreds of psi, with a typically range being from between 1 and 3 psi.

When the lamp 20 is turned off, the interior atmosphere decreases in temperature and contracts. This contraction produces a corresponding decrease in pressure in the interior 18. When the interior pressure decreases to a level less than the threshold level of the valve mechanism 24, the valve mechanism 24 closes to seal the interior 18 from the exterior environment. Moisture and contaminants do not flow into housing chamber during cool down. Because air cannot flow into the housing interior 18, a vacuum is created inside the housing, which prevents condensation and avoids corrosion and other problems associated with condensation.

A vacuum in a housing interior 18 would normally prevent anyone from being able to remove the faceplate assembly 14 to replace the lamp 20. However, the fixture 10 further includes a pressure equalization mechanism 26 that allows the equalization of the pressure difference between the atmosphere and the housing interior 18 when access to the interior is required, such as when replacing the lamp 20.

As shown in FIG. 3, each of the valve mechanism 24 and the pressure equalization mechanism 26 is partially or entirely positioned within and extends through a portion of an opening 34, 36 that extends through the support ring 28 between a side 30 which is adjacent the outside environment and a side 32 which is adjacent the interior of the fixture. The openings 34, 36 provide a means of interconnecting the housing interior 18 with the exterior atmosphere.

FIG. 4 is a more detailed view of one configuration of the valve mechanism 24. This valve mechanism 24 includes a hollow set screw 38 which engages a washer 40. The washer 40 forms a seal between the screw 38 and a duckbill valve 42, with the duckbill valve 42 compressing on the flange 41 as the screw 38 is tightened, also forming a seal between the duckbill valve and the flange 41. The hollow set screw provides a fluid path between the housing interior 18 and the duckbill value 42.

The side 30 of the support ring 28 which is exposed to the outside atmosphere, has a tapped, countersunk or counterbored portion for flush-mounting the pressure-equalization mechanism 26. It also has a counterbored pocket on the side 32 that is adjacent the interior 18. This pocket forms part of the opening 34 into which the valve mechanism 24 is placed. The pocket has a tapped counterbored for a vented setscrew or fastener to hold valve mechanism 24 in the interior 18 and a small hole in the top of the pocket to allow the venting of air from the housing interior 18 to the outside atmosphere.

The valve mechanism 24 may be a duckbill type valve as shown in FIGS. 3 and 4. In alternate configurations, the valve mechanism 24 may be any of several other known valve types such as diaphragm, ball, spring loaded piston, swing and horizontal lift check valves, to name a few. It is understood that the valve mechanism 24 shown is only illustrative of one way that it can be arranged. The pressure equalization mechanism 26 is shown as a screw device for simplicity and ease of discussion.

To ensure the sealing function of the screw, a washer may be included as part of the mechanism 26. The pressure equalization mechanism 26 may be any type of device that can be moved, through the application of an external force, between a closed position during which a seal is formed in the opening or an opened position during which fluid communication is established between the interior and the atmosphere such that gas can flow out of the housing interior 18. An example of one such device, would be a push button device having a construction similar to the pressure equalization mechanism of the device disclosed in U.S. Pat. No. 6,254,258.

In a preferred embodiment, in order to prevent unwanted openings of the pressure equalization mechanism 26, which can lead to the ingress of contaminants in the housing interior 18, the mechanism is a security type fastener. Such fasteners, which are available from Tamperproof Screw Company of New York (www.tamperproof.com), are designed so as not to be capable of removal with ordinary screw drivers. Instead, a special tool compatible with the fastener head-styles or drives is used to install and remove the fastener. In other embodiments the equalizing mechanism 26 can be configured with a lock for added security, such as a key lock, combination lock, or electronic lock, just to name a few. It is understood that the equalizing mechanism 26 shown is only illustrative of one way that it can be arranged.

As shown in FIGS. 3 and 4, each of the mechanisms 24, 26 is preferably configured to be compact so as not to extend above the exterior surface 30 of the support ring 28. The positioning of the mechanisms 24, 26 as such serves several functions. First, it reduces the possibility of damage to the mechanisms due to unintentional forces being applied to the devices. Second, it eliminates unnecessary protrusions from the fixture and thus provides for a more esthetically pleasing fixture.

The mechanisms 24, 26 are also configured so as not to extend too far beyond the interior surface 32 of the support ring 28. The pressure-equalization mechanism 26 is generally configured so that its threaded portion is not long enough to extend through the hole 36. As shown in FIG. 4, the set screw 38 of the valve mechanism may extend slightly into the housing interior. In other configurations, the threaded insert 38 may be sized so as to be flush with the interior surface 32. In either case, the valve mechanism 24 is configured to consume little, if any, interior space and to not interfere with any internal components of the fixture.

As shown in FIG. 2, the support ring 28 of the faceplate assembly 14. Includes a number of holes 44 which typically receive screws that are used to secure the faceplate assembly to the housing. In another embodiment of the fixture 10, one of the holes 44 may be used to receive the pressure equalization mechanism 26. In this configuration, the housing shell 13 would be configured such that one of its screw bores 46 (FIG. 1) is in fluid communication with the housing interior 18. The pressure equalization mechanism 26 would be inserted into that bore and function to secure the faceplate assembly 14 to the housing shell 13 and to allow for the venting air and pressure equalization between the housing interior 18 and the atmosphere.

As previously stated, the present invention may find application in other types of lighting fixtures, other then in-grade fixtures. For example, as shown in FIG. 5, the invention may be applied to an above-ground sealed lighting fixture 50 having a main housing body 52 and a cap 54 that removably attaches to housing body to allow replacement of lamp 56 located inside the housing interior formed by housing body 52 and cap 54. The housing 52 connects to a knuckle joint 58 that allows the angular adjustment of the lighting fixture 50 and through which electrical wiring 60 passes. The knuckle joint 58 attaches to a junction box or some other device (not shown) that is suitable for supporting the lighting fixture 50.

In accordance with the invention, a valve mechanism 62 is positioned at the bottom of the housing body 52 while a pressure-equalization mechanism 64 is positioned at the side of the housing body. The configuration of the valve mechanism 62 and pressure-equalization mechanism 64 may be the same as those previously described with respect to in-grade lighting fixtures. For example, the valve mechanism 62 may be a duckbill type valve or a diaphragm type valve while the pressure-equalization mechanism 64 may be a sealing screw. Each mechanism 62, 64 is positioned in a hole through the housing body 52 and establishes fluid communication with the atmosphere when in an opened condition.

Although the respective valve mechanism 62 and pressure-equalization mechanism 64 are shown attached to the bottom and side of the housing body 52, either could be placed in any location on the housing body 52 that allows for the establishment of fluid communication with the atmosphere. In a preferred embodiment, the valve mechanism 62 is positioned at the bottom of the housing 52 to reduce the possibility of particulate matter from entering the portion of the housing body 52 hole that is exposed to the environment and interfering with the venting operation of the valve mechanism 62.

Each of the valve mechanism 62 and pressure-equalization mechanism 64 is threaded into an opening in the housing body 52 prior to or after shipment of the fixture 50 to the user. After the mechanisms 62, 64 are threaded into the housing body 52, housing body becomes air-tight or sealed and fluid should not be able to enter the housing except through the pressure-equalization mechanism 64 as described below.

After fixture installation, when the user tightly secures the cap 54 on the housing body 52 the pressure build-up inside housing interior is vented to the atmosphere through the valve mechanism 62. The venting of the pressure build-up from inside the housing allows the user to easily place the cap 54 on housing body 52 and lock it into place to form a sealed lighting fixture 50.

During initial fixture operation, any pressure increase of the air inside housing that results from the increase in temperature due to the lamp 56 being on is vented, along with any water vapor that may be in the housing interior, through the valve mechanism. During this time, outside air is prevented from entering the housing interior due to the valve mechanism 62 and the venting action taking place from the interior to the atmosphere. When the lamp 56 is turned off, the pressure drops inside the housing interior due to the decrease in temperature. When the interior pressure decreases to a level less than the threshold level of the valve mechanism 62, the valve mechanism closes to seal the housing interior from the exterior environment. Moisture and contaminants do not flow into housing chamber during cool down. Because air cannot flow into the housing interior, a vacuum is created inside the housing, which prevents condensation and avoids corrosion and other problems associated with condensation.

The pressure-equalization mechanism 64 provides for easy replacement of the lamp 56 by allowing the user to equalize the pressure inside the housing with the atmosphere. To equalize the pressure, the user need only move the pressure-equalization mechanism 64 to its opened position by, for example, turning the threaded mechanism to loosen it. When the mechanism 64 is opened, the housing interior is placed in fluid communication with the atmosphere. Due to this operation, atmospheric air flows from outside the housing to the housing interior to allow the user to easily remove the cap 54 from the housing body 52. After the lamp 56 is replaced, the entire initial heat-up and pressure relief process is repeated, thereby once again creating a vacuum inside the housing interior to prevent condensation.

It will be apparent from the foregoing that while particular forms of the invention have been illustrated and described, various modifications can be made without departing from the spirit and scope of the invention. Accordingly, it is not intended that the invention be limited, except as by the appended claims.

We claim:

1. A lighting fixture, comprising:

a housing assembly having an interior;

a light source positioned in the interior and electrically connected to be turned on and off;

at least two openings on the same side of and through the housing assembly interconnecting the interior with the atmosphere;

a valve positioned in one of the openings, the valve configured to open when the light source is turned on long enough to cause the air pressure in the interior to exceed a predetermined pressure and to close when the light is turned off long enough to cause the air pressure in the interior to fall below the predetermined pressure; and a sealing device normally closing the other of the openings and configured to open in response to an external force.

2. A lighting fixture assembly, comprising:

a housing assembly forming an interior;

a valve mechanism associated with the housing assembly and configured to automatically vent fluid from the interior to the atmosphere when the pressure in the interior exceeds a threshold level, and to otherwise seal the interior from the atmosphere; and a pressure-equalization mechanism spatially apart from the valve mechanism and associated with the housing assembly, the pressure-equalization mechanism configured to, upon activation, substantially equalize the interior pressure with the atmosphere pressure, and to otherwise seal the interior from the atmosphere.

3. The assembly of claim 2 wherein the housing assembly comprises first and second openings interconnecting the interior with the atmosphere, the valve mechanism is in the first opening and the pressure-equalization mechanism is in the second opening.

4. The assembly of claim 2 wherein the housing assembly comprises a faceplate assembly, a portion of which is positioned to be exposed to the atmosphere and the valve mechanism and pressure-equalization mechanism are each associated with the exposed portion of the faceplate assembly.

5. The assembly of claim 4 wherein the exposed portion has an exposed surface and the valve mechanism does not extend above the exposed surface.

6. The assembly of claim 4 wherein the exposed portion has an exposed surface, the pressure-equalization mechanism has a closed position and the pressure-equalization mechanism does not extend above the exposed surface when in the closed position.

7. The assembly of claim 4 wherein the exposed portion of the faceplate assembly comprises first and second openings interconnecting the interior with the atmosphere, the valve mechanism is in the first opening and the pressure-equalization mechanism is in the second opening.

8. The assembly of claim 4 wherein the housing assembly comprises a housing and the exposed portion of the faceplate assembly comprises a plurality of holes for securing the faceplate to the housing, one of the holes interconnecting the interior with the atmosphere and the pressure-equalization mechanism is in that hole.

9. The assembly of claim 2 further comprising:

a junction box coupled to the housing assembly, the junction box comprising an interior at atmosphere pressure, and;

an opening interconnecting the housing interior with the junction box interior;

wherein the valve mechanism is in the opening.

10. The assembly of claim 2 wherein the valve mechanism comprises a check valve.

11. The assembly of claim 10 wherein the check valve comprises a duckbill valve.

12. The assembly of claim 10 wherein the check valve comprises a diaphragm valve.

13. The assembly of claim 2 wherein the pressure-equalization mechanism comprises a self-sealing screw.

14. The assembly of claim 2 wherein the pressure-equalization mechanism comprises a push-button valve.

15. A lighting fixture, comprising:

a housing assembly having an interior and two openings connecting the interior to the atmosphere;

a one-way valve positioned in one of the openings, the one-way valve configured to open when the pressure of the interior is greater than a predetermined pressure and otherwise being closed to form a seal between the interior and the atmosphere; and a pressure-equalization device, separate from the valve and positioned in the other of the openings, the pressure-relief device having an opened state during which fluid communication is established between the interior and the atmosphere and a closed state during which a seal is formed between the interior and the atmosphere.

16. The fixture of claim 15, wherein the pressure between the interior and the atmosphere equalizes when the pressure-equalization device is opened.

17. The fixture of claim 15 wherein the pressure- equalization device is configured to move from the closed state to the opened state through the application of an external force.

18. The fixture of claim 15, wherein the housing assembly comprises a faceplate assembly and the two openings are in the faceplate assembly.

19. The fixture of claim 15, further including a junction box having an interior in communication with the atmosphere, the junction box coupled to the housing interior through the one-way valve.

20. A first subassembly configured to be secured to a second subassembly to form a lighting fixture housing assembly having an airtight interior relative to the atmosphere, said first subassembly comprising:

a structure having opposed first and second surfaces and two openings extending between the surfaces;

a valve positioned in one of the openings, the valve configured to open when exposed to a pressure greater than a predetermined pressure and otherwise being closed to form a seal in the opening; and a pressure-equalization device, separate from the valve and positioned in the other of the openings, the pressure-relief device having an opened state during which fluid communication is established between the first surface and the second surface and a closed state during which a seal is formed in the opening.

* * * * *